US007950241B2

(12) United States Patent
Baker

(10) Patent No.: US 7,950,241 B2
(45) Date of Patent: May 31, 2011

(54) VAPOR COMPRESSION AND EXPANSION AIR CONDITIONER

(76) Inventor: David M Baker, Mosinee, WI (US)

( * ) Notice: Subject to any disclaimer, the term of this patent is extended or adjusted under 35 U.S.C. 154(b) by 35 days.

(21) Appl. No.: 12/517,421

(22) PCT Filed: Nov. 12, 2008

(86) PCT No.: PCT/US2008/083192

§ 371 (c)(1),
(2), (4) Date: Jun. 3, 2009

(87) PCT Pub. No.: WO2009/064760

PCT Pub. Date: May 22, 2009

(65) Prior Publication Data

US 2010/0005817 A1 Jan. 14, 2010

Related U.S. Application Data

(60) Provisional application No. 60/987,332, filed on Nov. 12, 2007.

(51) Int. Cl.
*F25B 1/00* (2006.01)

(52) U.S. Cl. ..... 62/115

(58) Field of Classification Search ..... 62/115, 62/235.1, 498

See application file for complete search history.

(56) References Cited

U.S. PATENT DOCUMENTS

| | | | | |
|---|---|---|---|---|
| 1,257,004 | A | 2/1918 | Humphrey | |
| 3,992,898 | A | 11/1976 | Duell et al. | |
| 4,006,602 | A * | 2/1977 | Fanberg | 62/113 |
| 4,030,303 | A | 6/1977 | Kraus | |
| 4,120,160 | A | 10/1978 | Davis | |
| 4,211,207 | A | 7/1980 | Molivadas | |
| 4,240,260 | A | 12/1980 | Gustafson | |
| 4,358,929 | A | 11/1982 | Molivadas | |
| 4,479,354 | A | 10/1984 | Cosby | |
| 4,501,122 | A | 2/1985 | Cutler | |
| 5,097,677 | A * | 3/1992 | Holtzapple | 62/500 |
| 6,412,281 | B2 | 7/2002 | Cover | |
| 6,931,852 | B2 | 8/2005 | Yatsuzuka | |
| 7,019,412 | B2 | 3/2006 | Ruggieri | |
| 7,073,331 | B2 | 7/2006 | Oda | |
| 7,185,491 | B2 | 3/2007 | Oda | |
| 7,246,492 | B2 | 7/2007 | Hendrix | |
| 2005/0257525 | A1 | 11/2005 | Komaki | |

FOREIGN PATENT DOCUMENTS

| | | | |
|---|---|---|---|
| GB | WO 2006/082440 | A3 | 8/2006 |
| KR | 20-1990-0017458 | U | 10/1990 |
| WO | WO 2006/082440 | A3 | 8/2006 |

OTHER PUBLICATIONS

Swift, Gregory, Malone Refrigeration, Los Alamos Science No. 21, 1993, pp. 112-123. Los Alamos NM.

Fisher, Steve, and Labinov, Solomon; Pulse-Tube Refrigeration and Malone Cycle Refrigeration, Not-In-Kind Technologies for Residential and Commercial Unitary Equipment, Feb. 2000, pp. 51-60. Oak Ridge National Laboratory, Oak Ridge, Tennessee.

* cited by examiner

*Primary Examiner* — Melvin Jones
(74) *Attorney, Agent, or Firm* — Lane Patents LLC

(57) ABSTRACT

The present invention is drawn to a method for creating a refrigeration system comprising a piston device for the compressor and expander functions normally provided by a Carnot cycle. Solutions for modifying the overall system to utilize the pulsed nature of the piston action are provided.

19 Claims, 7 Drawing Sheets

VAPOR COMPRESSION AND EXPANSION AIR CONDITIONER

CROSS-REFERENCE TO RELATED APPLICATIONS

This application depends from U.S. provisional application No. 60/987,332; filed on 12 Nov. 2007, and PCT/US08/83192 filed on 12 Nov. 2008; which applications are incorporated herein by reference.

FIELD OF THE INVENTION

The present invention is directed toward apparatus used to provide refrigeration or air conditioning to an enclosure. More specifically, a means for compressing and expanding a vaporized refrigerant using a large piston device for converting low grade heat in to useful energy, mechanical work and the like.

BACKGROUND OF THE INVENTION

Most refrigerant air conditioners rely on the 'refrigeration cycle' generally comprising four standard processes:

1) The refrigerant starts as a vapor at low pressure inside an electrical motor driven compressor. Pressure is increased which increases the temperature of the refrigerant vapor as it compresses and flows toward a condenser.

2) Inside the condenser, heat is released from the high pressure refrigerant to the outside air due to a temperature gradient, causing the refrigerant to condense and become a high pressure, high temperature liquid.

3) The refrigerant next flows towards a pressure regulation valve, which causes an adiabatic expansion of the refrigerant, causing a phase change to vapor, causing the temperature of the refrigerant to drop below the temperature of the refrigerated space resulting in a cold, low pressure vapor.

4) The cold refrigerant vapor flows to the evaporator where it absorbs heat from the indoor air to the refrigerant. The warmed vapor flows back to the compressor where the cycle is repeated.

Typically, the condenser is powered by electricity, and most commercial air conditioners have an energy-efficiency rating that lists how much heat (measured in BTU per hour) is removed for each watt of power the air conditioner draws. These efficiencies improve with more efficient compressors, larger and more effective heat exchanger surfaces, improved refrigerant flow and other features.

The present invention shows advantages over other refrigeration systems in that system is mechanical, using a piston to perform the duties commonly associated with a compressor and an evaporator while drawing energy from low grade waste heat energy without significant work done by electricity for cooling. Further, the preferred embodiment runs directly from solar energy which is concentrated by a U-tube type concentrator to power the refrigeration system.

Overview of A/C System

The present refrigeration system takes in refrigerant starting in vapor form, and compresses it during a heat pump cycle. The pressurized refrigerant flows through a refrigeration inlet valve into a condensation unit containing a heat exchanger. The heat exchanger removes heat from the refrigerant causing it to condense. The condensed refrigerant then collects into a condenser tank. The condenser tank is connected with an evaporator tank through a pressure regulator. The evaporator tank is also in connection with a heat exchanger forming a loop for receiving heat from the enclosure to be cooled, such as a building. Additionally a pre-heater may be added between the condenser tank and the evaporator tank aid in heat transfer.

The loop for receiving heat from the space to be cooled is formed in this instance by a pipe having heat exchanger fluid, forming a heat exchanger loop between the evaporator tank heat exchanger and the enclosure heat exchanger, located inside the enclosure to be cooled. The cold reservoir of condensed refrigerant inside the evaporator tank cools the evaporator tank heat exchanger. The warmer air of the enclosure transfers via the enclosure heat exchanger into the system.

The compression and expansion stages can be accomplished using one element within the preferred embodiment of a U-tube concentrator; the compression and expansion strokes of the liquid piston. Those skilled in the art may devise other means for providing compression and expansion at one location, by using a pump, piston or similar means not connected with a liquid piston which does not depart from the present invention.

U-Tube as Solar Concentrator

Three major technologies are currently being used for concentrating solar heat generation to produce useful work; the parabolic trough, the power tower, and the sterling dish. The costs of generating electricity from these power sources are high. All three require a high working temperature, which creates problems with maintenance and high seal failure rates.

With these technologies, the solar radiation is concentrated real time under direct sunlight resulting in high working temperature at the point of collection. This higher temperature generally leads to higher thermal losses. In addition, the high temperature requirements of these systems for minimal thermal loss typically forces the use of more expensive and complicated collectors and thermal storage units. This constraint leads to higher costs for these solutions.

With the advent of low temperature solar concentrators such as those disclosed in U.S. patent application Ser. No. 11/387,405, and U.S. patent application Ser. No. 11/860,506 both included herein by reference, it is desirable to minimize condensation from saturated vapors associated with thermodynamic cycles in the heat engine cycle which run at or near the phase change point. Such improvements increase the efficiency and allow use of a lower grade of thermal energy.

The preferred embodiment utilizes a dual loop U, or other suitably formed heat actuated liquid piston heat pump, where one leg comprises a heat engine and the other leg comprises a heat pump. Those skilled in the art will appreciate that it can broadly be applied to any method or apparatus which runs a thermodynamic cycle at or near the condensation point of a vapor.

These floating pistons are usually constructed from a solid material, for example, aluminum, non corrosive steel, or other suitable material. They should be designed to withstand the conditions of temperature and pressure found in the system.

The heat engine section operates using a thermodynamic cycle from a natural or waste heat source, such as, but not limited to, solar energy. Fluid, typically water, in the liquid or steam form, is transferred between the solar collectors and the heat engine as part of the heat engine loop.

The heat pump loop is connected to the outlet and inlet of the refrigeration system and the heat pump expansion chamber is substantially filled with a refrigerant typically in a substantially vapor form.

A further advantage of the present invention is that the refrigeration increases with higher ambient heat, when it is most needed. This increase in output comes from several factors, but the most significant, is the temperature-pressure characteristics of the steam used in the U-tube concentrator. When used with flat panel solar collectors, the available steam input temperature increases with ambient temperature because the collector losses to ambient decrease as the ambient temperature rises.

As a reference, at a steam input temperature of 170° F.; 6 psig is available for the down stroke of the heat engine piston. At a steam input temperature of 200° F.; 11.5 psig is available. Since the power available from the heat engine is proportional to the steam pressure, this provides a substantial increase in power.

Further, the corresponding exhaust pressure does not rise proportionately. As useful work is a function of the difference between steam input steam temperature and ambient output temperature, a rise in output temperature robs system power. However, increase in rejection temperature causes a much smaller increase in exhaust pressure and a correspondingly smaller decrease in power compared with the gains at the input. For example, at a 100° F. exhaust temperature, the exhaust pressure is 0.9 psi. For a 130° F. exhaust temperature, the exhaust pressure only increases to 2.2 psi.

It should be noted that the present system can operate at much lower temperatures than previous systems and can be scaled as temperature rises. The same conditions causing a need for increased cooling, intense sunlight and heat also improves output capacity of the system. Additionally as conditions moderate, output is reduced with demand, but the system can even operate with heat input from thermal storage collected during peak hours. This feature offers a tremendous advantage over other systems that can only work under direct solar radiation.

The Heat Engine Cycle of the Preferred Embodiment (Water)

The isentropic compression process of the typical Carnot cycle starts with a working fluid such as water in the steam phase and ends with liquid phase. Whereas the present cycle starts with wet steam and ends with saturated vapor. The disclosed process is relatively unintuitive because condensation from a vapor to a liquid is commonly associated with a compression process.

In the present cycle, the compression process is constrained to form saturated vapor to maintain constant entropy as required by the process.

In the present embodiment, only approximately 12.5% of the wet steam mixture is liquid at the beginning of the compression process. At the beginning of the process, the specific entropy of the liquid is approximately 0.53 kJ/kg-° K and the specific entropy of the vapor is approximately 8.32 kJ/kg-° K. At the end of the compression process, the specific entropy of the liquid is approximately 1.31 kJ/kg-° K and the specific entropy of the vapor is approximately 7.36 kJ/kg-° K.

Quantitatively, an algebraic calculation equating total entropy at the beginning and end of the compression process with a single unknown of the amount of mass that changes between phases provides the result of vapor at the end of the cycle. Qualitatively, it can be seen that the relatively low percentage of liquid in the system at the beginning of the process drives the process to produce vapor. Because the majority of the system initially consists of high entropy vapor, converting all the vapor to liquid at approximately 16% of the specific entropy cannot be a constant entropy process. However, if the process produces vapor at approximately 88% of the initial vapor specific entropy, constant entropy can be maintained, with the approximately 13.9 times increase in the liquid to vapor entropy balancing the approximately 12% drop in the specific entropy of the initial vapor mass.

In a typical Carnot cycle that has a high initial percentage of liquid, the process is suboptimal. In this case, using the same starting and ending entropy values, the specific entropy of the majority of the mass, which is liquid, increases by a factor of approximately 2.5, if the final result is liquid. The mass of vapor that condenses drops in entropy by a factor of approximately 6.4 to balance out the increase in entropy of the liquid. The small drop in entropy of the initial vapor reduces the useful work which can be done by the system.

Therefore, it can be seen by one skilled in the art that there remains an incentive to maintain as much working fluid in the vapor phase as possible at the end of the process. By reducing the number of surfaces inside the chamber, including the piston head, where condensation can occur, this new cycle can be enabled with greater efficiencies as shown above.

The Heat Pump Cycle of the Preferred Embodiment

A refrigeration system can be attached to the heat pump side of the concentrator, which receives work done by the heat engine cycle. Those skilled in the art will recognize that other methods and apparatus can be used to generate similar types of work to operate an air conditioner system, while maintaining the spirit of the invention. The heat engine described herein is but one source of potential work to power a piston based refrigeration system.

The heat pump side of a U-tube concentrator contains the heat pump and the heat pump chamber, representing the heat pump cycle of the system. Further the U-tube concentrator operates with large volumes and low frequencies which is well suited to the compression and evaporation processes.

The heat pump loop is connected to the outlet and inlet of the refrigeration system and the heat pump chamber is filled with a refrigerant, such as HCFC-123, also known as "refrigerant-123" or "R123." As can be appreciated, those skilled in the art may be able to use other refrigerants or working fluids without departing from the spirit of this invention.

The heat pump piston serves to separate the liquid connecting rod, typically water, from the refrigerant inside the heat pump chamber. The heat pump piston should be designed such that a seal is formed between the piston and the piston wall. An alternative embodiment of the U-tube concentrator allows the concentrator to operate a turbine or a refrigeration system. An additional inlet and outlet valve can be installed on the heat pump expansion chamber controlling the flow of the working fluid into a turbine attachment. The turbine could be designed to use the same energy source as the refrigeration system as disclosed. Energy allocated between the turbine and air conditioner may be controllable.

An additional advantage of using R-123 in the turbine instead of steam, results from turbine design parameters. For efficient design and operation of a vapor turbine, the optimal blade speed is proportional to the enthalpy change of the fluid as it passes through the stage. As a result, efficient turbine design requires tradeoffs between combinations of high blade speeds, large mass flow rates (high power), and small changes in enthalpy. This combination often results in large (1 to 500 MW) turbines or very high speeds (120,000 rpm) for small (30 to 100 kW) turbines. The enthalpy change of R-123 at typical concentrator output and input pressure is an order of magnitude less than the enthalpy change of steam for the same pressures. This allows for the selection of smaller power levels and lower speeds while maintaining the same turbine efficiency, making the system more suitable for distributed generation.

Another advantage of using R-123 in the turbine is that the fluid working temperature for the typical pressures can be 250° F. lower with R-123 than with steam. This provides substantial advantages in both the concentrator and the turbine in the areas of thermal expansion and material selection, particularly in the areas of seals and bearings.

A control system, typically electronically based, may be used to regulate the work distribution between the heat engine cycle and the heat pump cycle by receiving input from a variety of sensors along the concentrator and refrigeration system and controlling valves, pumps and the like at points along the system. A similar or separate control system may be used to allocate energy between the alternative turbine attachment and the refrigeration system.

It is an advantage of the invention that it cools an enclosure without being electrically powered, therefore not taxing existing electrical grid systems.

It is another advantage of the invention that is can cool an enclosure without creating a carbon foot print with regard to greenhouse gases.

It is another advantage of the invention that it combines the expansion and compression stage of the refrigeration cycle with one device.

It is another advantage of the invention that it scales, providing more cooling as temperatures rise.

It is another advantage of the invention that it is able to provide power using previously stored thermal energy.

It is another advantage of the invention it operates efficiently under high ambient temperatures (above 100° F.).

It is another advantage of the invention that waste heat rejected into the environment by ambient air cooling.

It is another advantage of the invention the waste heat rejected into the environment does not require evaporative cooling.

It is another advantage of the invention that it is powered by a U-tube concentrator.

It is an advantage of the invention that the invention can share power between a turbine and a refrigeration system.

DETAILED DESCRIPTION OF FIGURES

Refrigeration System Operation

Figure 1:
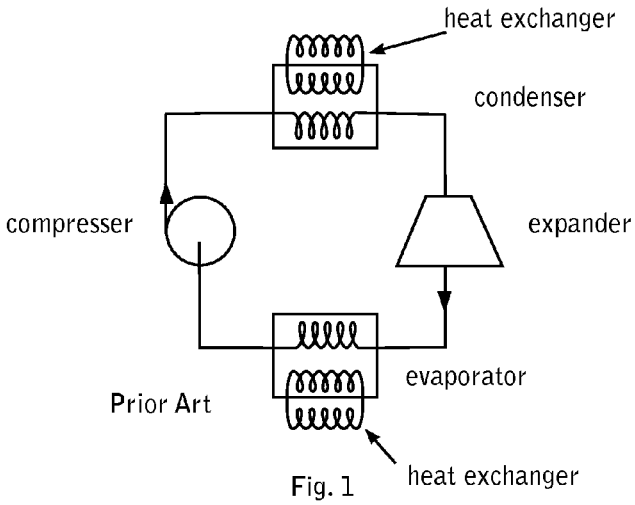
FIG. 1 is an exemplary layout of a prior art refrigeration system.
Figure 2:
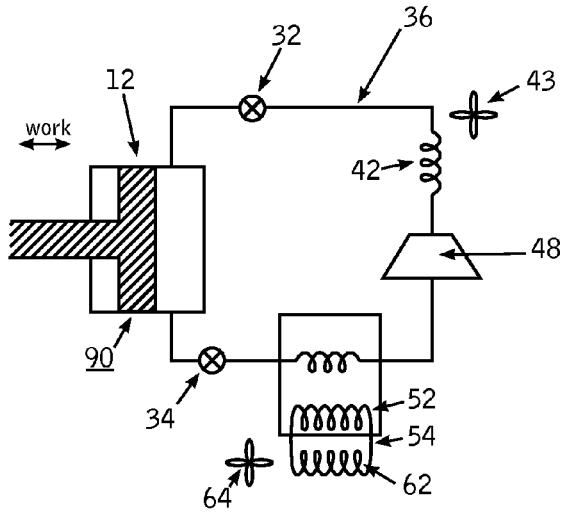
FIG. 2 is an exemplary layout of one embodiment of a refrigeration system incorporating the present invention.
Figure 3:
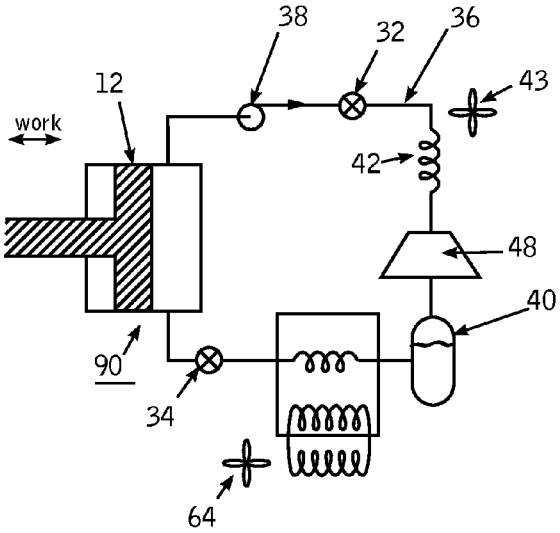
FIG. 3 is an exemplary layout of an alternate embodiment of a refrigeration system incorporating the present invention.
Figure 4:
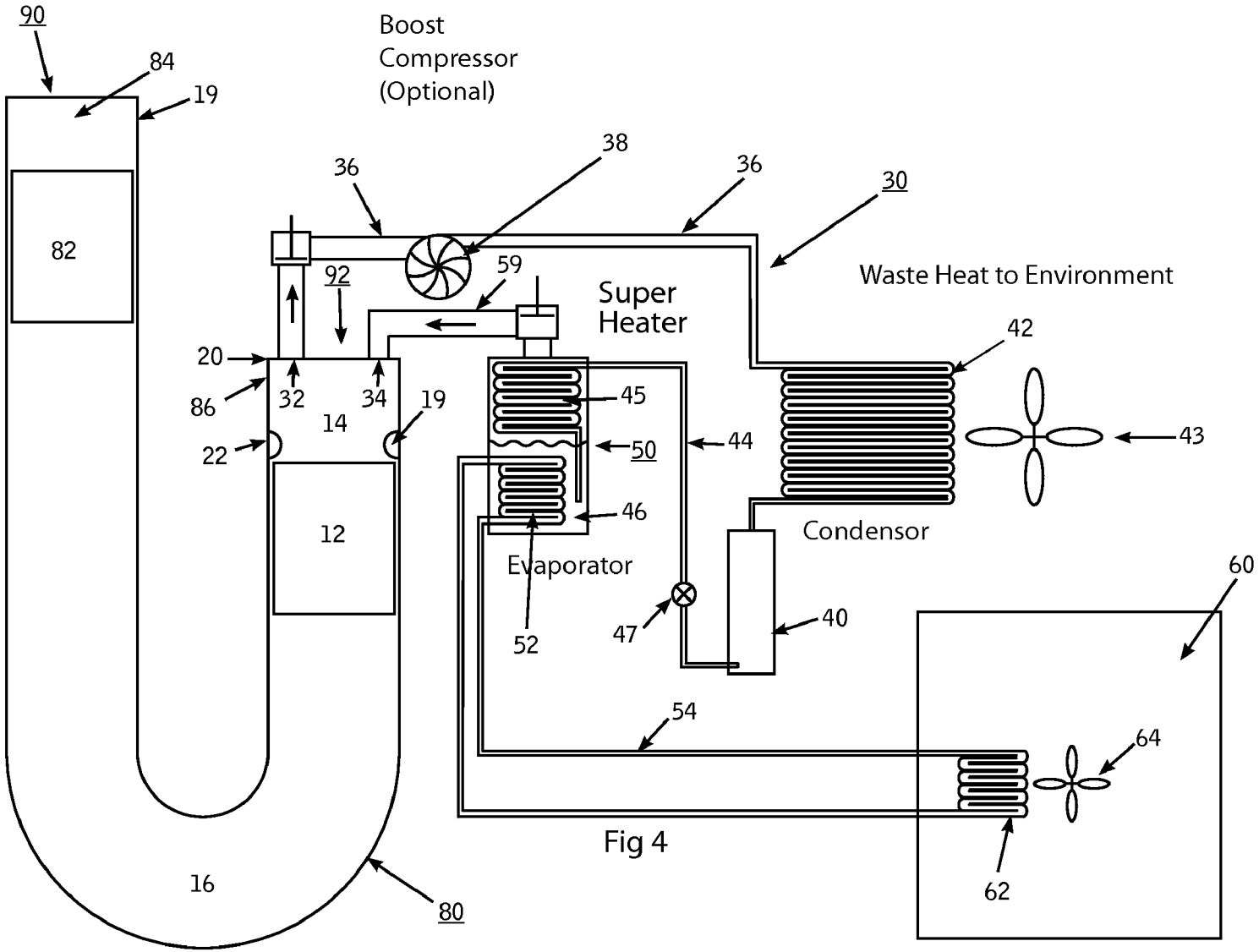
FIG. 4 is an exemplary layout of a preferred embodiment of a refrigeration system incorporating the present invention.
Figure 5:
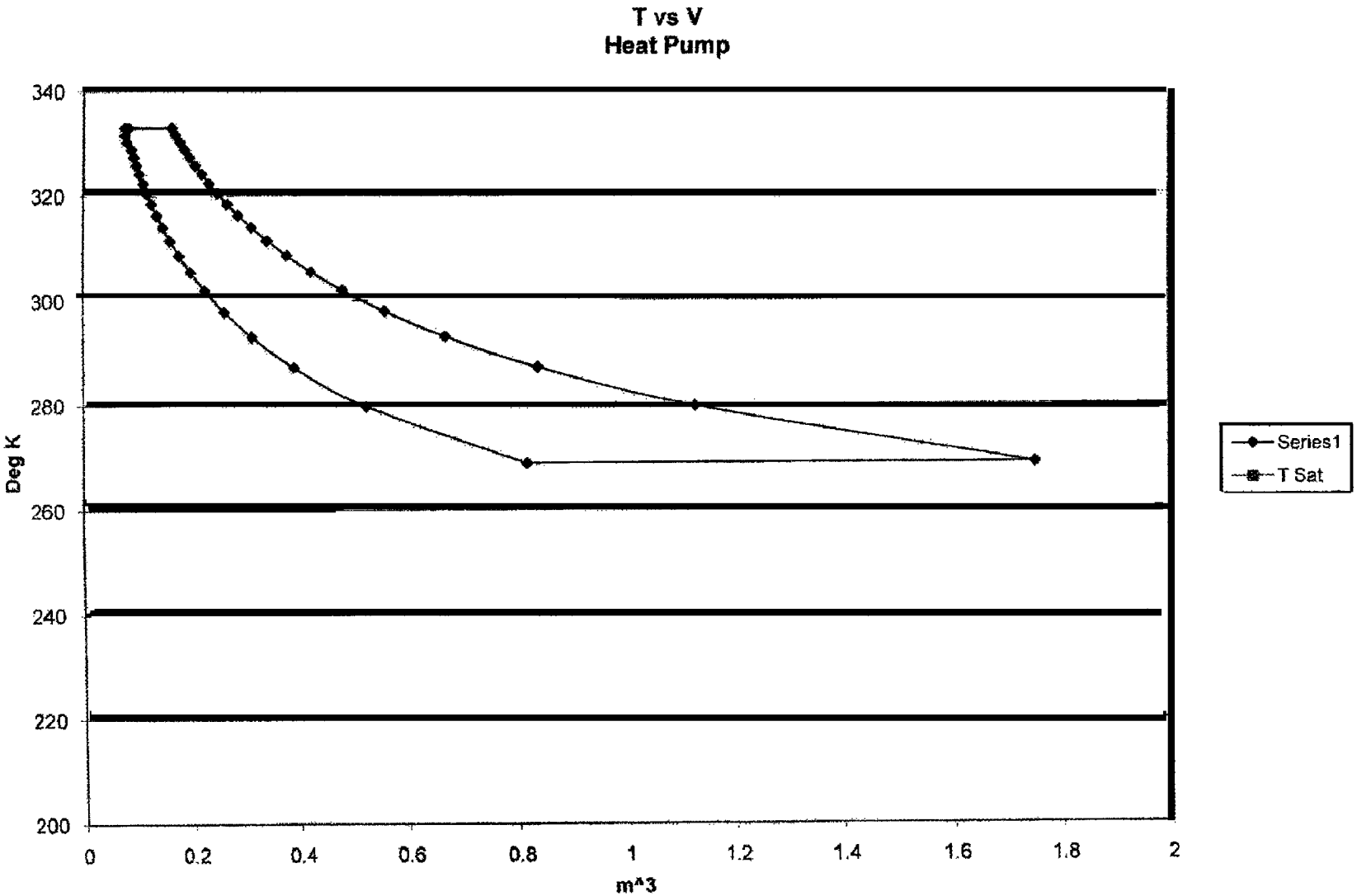
FIG. 5 shows an exemplary T-V diagram for an embodiment of a heat pump cycle.
Figure 6:
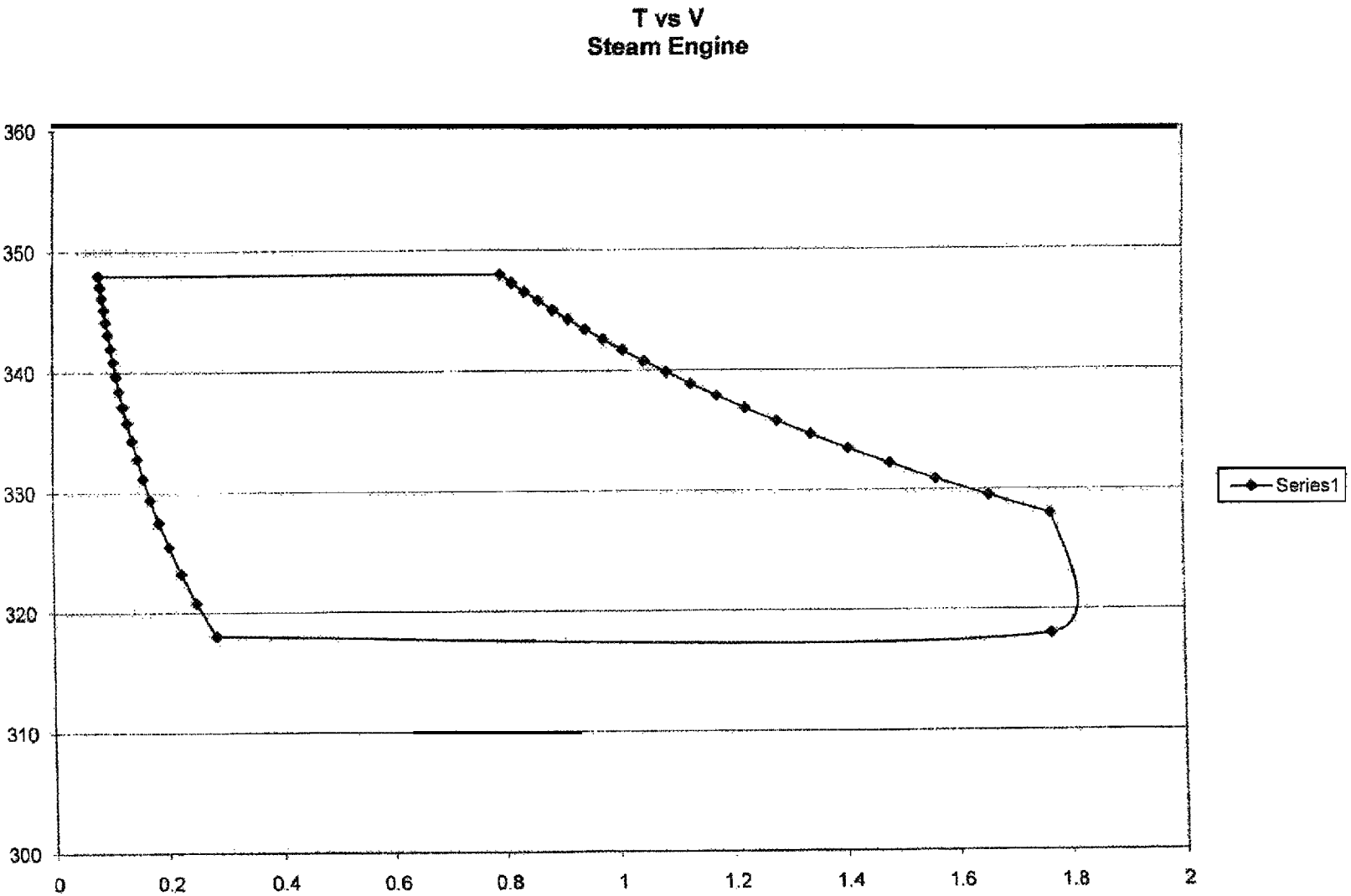
FIG. 6 shows an exemplary T-V diagram for an embodiment of a steam engine cycle.
Figure 7:
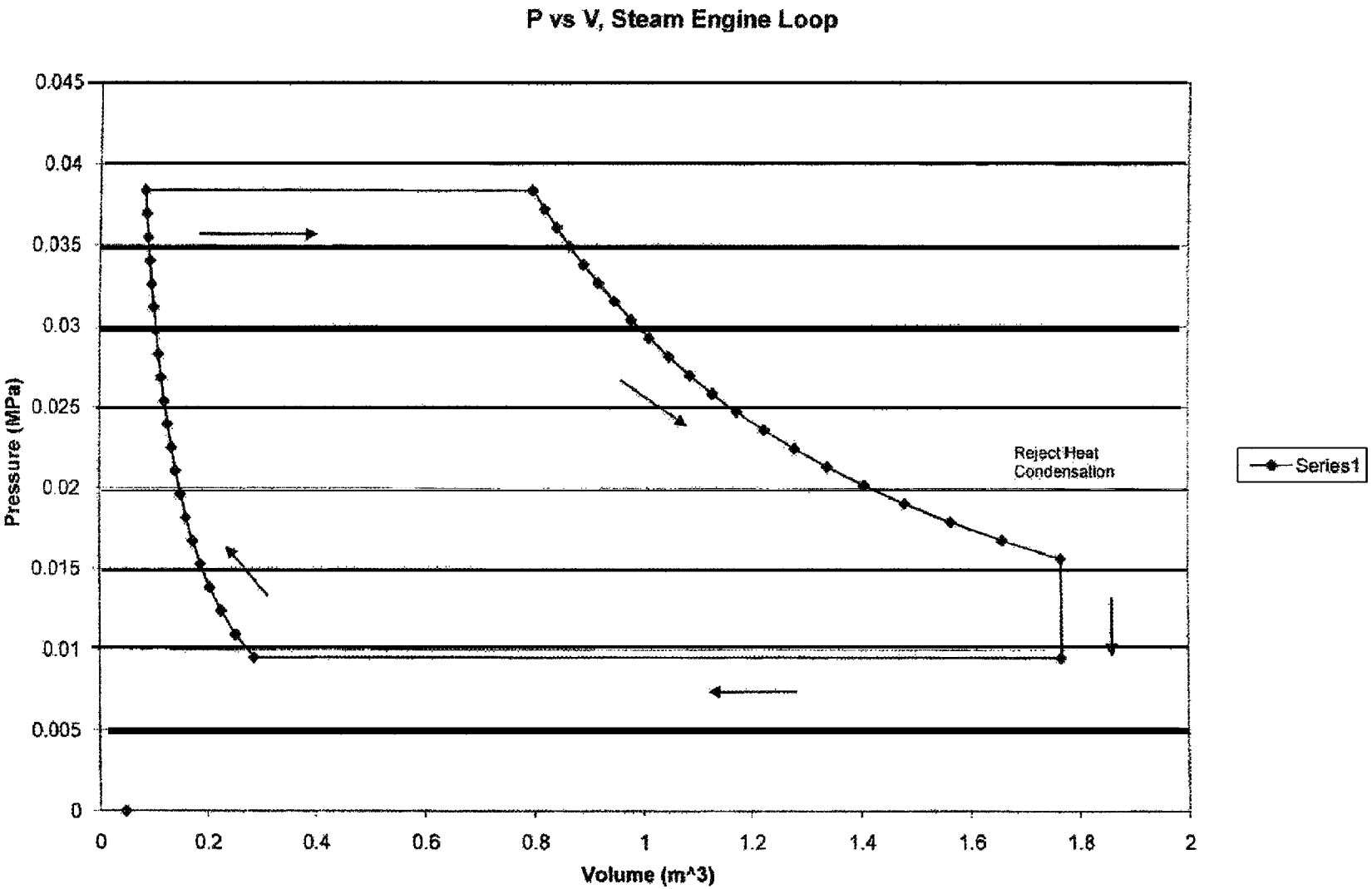
FIG. 7 shows an exemplary P-V diagram for an embodiment of a steam engine cycle.
Figure 8:
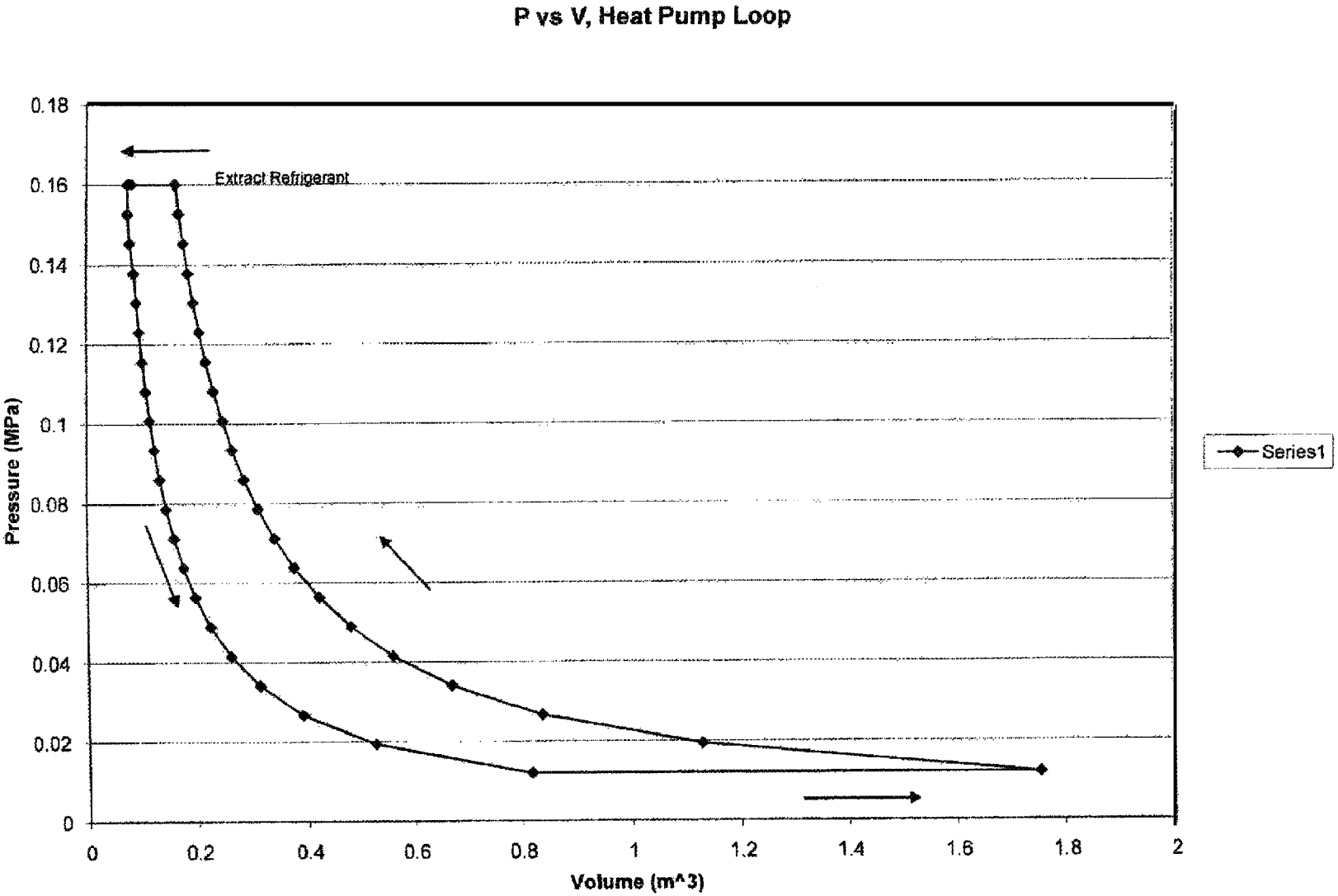
FIG. 8 shows an exemplary P-V diagram for an embodiment of a heat pump cycle.
Figure 9:
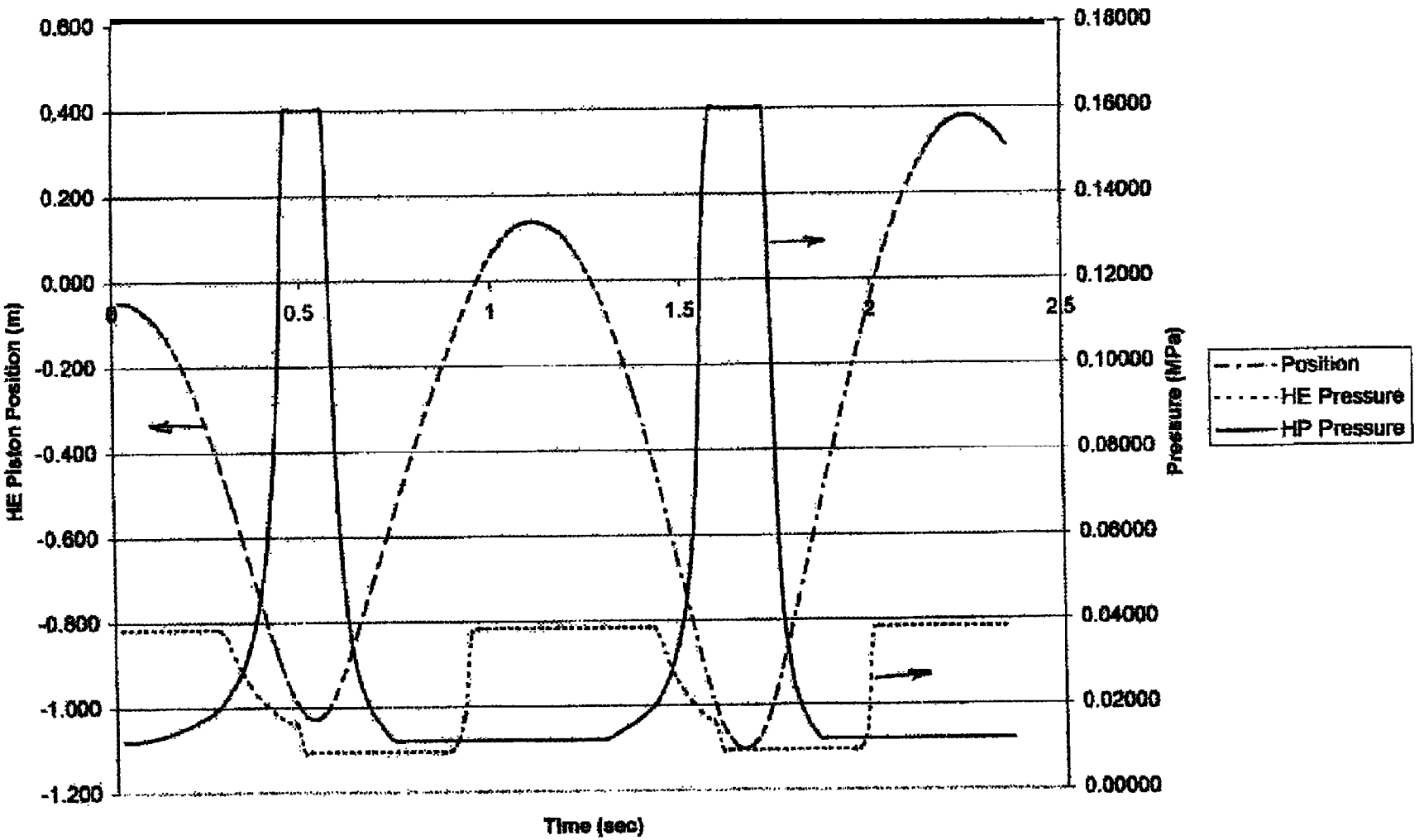
FIG. 9 shows an exemplary time plot for piston strokes showing piston head position verses steam engine (HE) pressure and heat pump (HP) pressures respectively.

FIG. 1 is an exemplary layout of a refrigeration system comprising an embodiment of the current invention. Refrigerant 10, as a vapor that can be either saturated or superheated is sent through an outlet valve 32 through piping 36, preferably copper pipe or other suitable material and sized for the appropriate stage, toward a condensation unit 40. An optional boost compressor 38 may be added as desired to further raise the pressure in the refrigerant system 30.

The temperature of the refrigerant 10, still primarily a vapor, is desired to be higher than the ambient, or outdoor temperature to promote condensation. A condensation heat exchanger 42, transfers heat from the refrigerant into the environment in the form of waste heat thus cooling the refrigerant 10 and causing condensation. A collector 40, collects the resulting liquid which pools at the bottom of the collector. In the preferred embodiment, the collector 40 should be sized to provide a constant flow of refrigerant from the reservoir 40 from the pulsed flow provided by the condenser 42.

The refrigerant 10 flows along piping 44, through a pressure regulation valve 47 to an evaporator tank 50. Typically the collector 40 side of the pressure regulation valve 47 maintains a pressure of approximately 40 psia, while the evaporator tank 50 side may reach as low as 2 psia due to the action of the piston device 17. For this reason, the pressure regulation valve 47 is preferably designed to restrict flow sufficient to provide a substantially constant flow of refrigerant 10.

A pre-heater region 45 can preferably be located in the evaporator tank 50, such that the exposed surface area is maximized inside the top half of the evaporator tank 50, and drains refrigerant 10, still substantially in the liquid phase, into the bottom half of the evaporator tank 50.

One function of the evaporator tank 50 is to collect cooled refrigerant 10, forming a refrigerant reservoir 46, to facilitate liquid conductive heat transfer with the evaporator tank heat exchanger 52. The temperature of the refrigerant 10 entering the pre-heater region 45 is higher than the refrigerant reservoir 46, allowing cooling of refrigerant 10 entering the refrigerant reservoir 46 while heating the refrigerant 10 entering the evaporation pathway 59. The evaporation pathway is typically comprised of copper or aluminum piping, or other suitable material and should be sized sufficiently to maximize evaporation effluent from the evaporator.

An evaporator tank heat exchanger 52 contacts the cooled refrigerant 10 of the refrigerant reservoir 46 drawing heat from an enclosure 60, such as a building or other space. Heat is drawn via an enclosure heat exchanger 62 and through fluid in a pipe, forming a heat exchanger loop 54. A fan 64 may be operated near the enclosure heat exchanger 62 to facilitate heat transfer.

One skilled in the art will recognize that care should be taken to prevent freezing of the refrigerant reservoir. The refrigerant reservoir 46 remains cool because of evaporation during the heat pump cycle. In terms of mass, the mass of the refrigerant 10 in the refrigerant reservoir 46 should be sufficient to provide a constant supply to the piston device 17.

Piston and Valve Operation

In the preferred embodiment, the compression and evaporation phases that make up the heat pump cycle are controlled by a piston and valve system. The refrigeration system 30 has an outlet valve 32 and inlet valve 34 leading to and from a piston device 17, preferably comprising a chamber 14, piston 12, liquid connecting rod 16 receiving work from a heat engine go. The piston device 17 comprises a chamber of a predetermined size and holds refrigerant 10 during the various stage of the cycle. The piston 12 moves inside the chamber 14. Compression occurs as the piston 12 approaches top dead center 20 in the compression stage. Expansion occurs as the piston 12 approaches bottom dead center 22 in the expansion stage.

With the piston 12 near top dead center 20, both valves 32 and 34 are closed. As the piston 12 descends, the chamber 14 starts to draw a vacuum as the chamber increases in volume. At a predetermined time point of descent, typically determined by a target pressure, the inlet valve 34 is opened and the refrigerant 10 entrained in the expansion pathway and the evaporator tank 50 expands isentropically into the chamber 14, decreasing in temperature and pressure within the evaporator tank 50.

The constant temperature and pressure are maintained by the evaporated refrigerant 58 in the evaporator tank 50. In practice, the temperature and pressure of the evaporated refrigerant 58 will drop slightly during the expansion stage and will then increase slightly when the outlet valve 34 is closed since heat is added continuously to the evaporator tank 50 and the evaporation occurs intermittently. The amount of variation is dependent upon the mass of refrigerant reservoir 46 in the evaporator tank 50.

At about bottom dead center 22, the inlet valve 34 is closed and the piston 12 begins its upward stroke. The refrigerant 10 is compressed isentropically during the compression stroke, raising its temperature and pressure. When the desired pressure is reached, the outlet valve 32 is opened and refrigerant 10 in vapor phase, is exhausted into the piping 36 toward the condensation heat exchanger 42. At top dead center 20 the outlet valve 32 is closed and the cycle starts over.

In a preferred embodiment the piston 12 is part of a U-tube concentrator 80. A liquid connecting rod 16, typically water, is used inside the concentrator 80 to connect the piston 12 and the heat engine piston 82.

The heat pump cylinder wall 18 and top piston surface of the piston 12 is preferred to be maintained above the saturation point of the R-123 so that condensation of the R-123 does not occur inside of the concentrator chamber 17 that contains the liquid connecting rod 16. The wall 18 temperature may vary along the height of the wall 18. A piston seal 19 is desired at the top of the piston 12 to separate the R-123 in the chamber 14 from the liquid connecting rod 16.

Another method of preventing condensation of the R-123 inside the concentrator chamber 17 is to maintain the temperature of the entire piston 12, cylinder wall 18, and water at a temperature above the saturation pressure of the R-123 at its highest point. For example, this temperature could be set at 44° C. Large quantities of waste heat the liquid R-123 returning from the condensation unit 40 is available to maintain this temperature. By maintaining primary points of contact above the R-123 saturation pressure, there will be no surfaces upon which the R-123 will condense.

It is preferred that the water temperature be maintained below the water saturation pressure for the lowest operating pressure seen in the concentrator chamber 17. In an example case, the water saturation temperature for the lowest operating pressure is 49° C. In this example; there is a 5° C. window in which the exposed surfaces may be maintained for favorable operation.

The use of the system is not limited to use with R-123 and water. It will be obvious to one skilled in the art that other working fluids could be used.

Turbine

The system can be equipped with a turbine 70 or generator 76 operating on R-123 refrigerant 10. This provides several advantages. First, the same concentrator 80 can provide refrigerant 10 to the refrigeration system 30 and to the turbine 70, providing flexibility to the end user. For example, the turbine 70 can be sized smaller than the maximum system output at high ambient temperatures lowering the cost of the turbine 70 and generator 76. The additional output capacity of the concentrator 80 during periods of high temperatures can then be utilized by the refrigeration system 30 to provide additional refrigeration capacity at a time when it is typically most needed.

An optional boost compressor 38 can be used to increase the pressure of the refrigerant 10 after discharge from the chamber 14, thus providing a higher allowable ambient discharge temperature if needed. Power for the boost compressor can be provided by auxiliary power or by a turbine 70 driven by the same refrigerant 10 used to power the refrigeration system 30, and controlling turbine inlet 72 and outlet valves 74 by the same principles and cycle used for the refrigeration system 30.

It will be apparent to one skilled in the art that minor variations in the timing of the valves 32, 24, 72 and 74 and other operating parameters can be made without changing the essence of the invention. For example, the amount of superheat, if any, that is added to the refrigerant 10 prior to its addition to the chamber 14 can be made to achieve different operating temperatures.

System Design Balance Between Heat Engine and Heat Pump

FIGS. 2 through 5 show how an embodiment of how a heat engine cycle and heat pump cycle can interact to convert thermal heating, such as solar heating, to refrigeration.

Care should be taken to design the system such that the input work provided by the heat engine 90 matches the work used by the heat pump 92 and the system losses. The work input per cycle is illustrated by the area enclosed by the PV curve shown in FIG. 4. The output work per cycle is illustrated by the area enclosed by the PV curve shown in FIG. 5.

The work provided by the heat engine go expansion stroke consists of both the PV work and work performed by the hydraulic head offset between the 2 sides of the U-tube 80. The kinetic energy of the system approaches zero at both top dead center 20 and bottom dead center 22, so the kinetic energy does not affect the work balance calculation. During the design, the head offset can be adjusted to assist in obtaining the work balance while achieving the desired operating pressures and temperatures.

Although certain example methods, apparatus, and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

We claim:

1. A method for refrigeration comprising:

a) providing a system for supplying a refrigerant, b) providing a condenser for removing enthalpy from said refrigerant, causing at least a portion of said refrigerant to condense to form liquid refrigerant, c) providing an evaporator in communication with the condenser for reducing the pressure of the liquid refrigerant whereby at least a portion of the liquid refrigerant forms a vapor causing heat to be removed from said refrigerant, d) providing a piston device, capable of containing refrigerant, and further being capable of forming a compression stage and an expansion stage, e) operatively coupling the piston device with the condenser and the evaporator;

f) whereby the compression stage of the piston device provides refrigerant to the condenser and, g) the expansion stage of the piston device receives refrigerant from the evaporator.

2. A method in accordance with claim 1 further comprising operating the condenser in conjunction with a heat exchanger for moving heat from the system to an outside environment.

3. A method in accordance with claim 1 further comprising operating the evaporator in conjunction with a heat exchanger for moving heat into the system from an enclosure.

4. A method in accordance with claim 1 further comprising adding work to the compression stage causing heating to the refrigerant.

5. A method in accordance with claim 4 further comprising at least one valve in connection with the piston device;

a) the method further comprising opening and closing the valve to provide refrigerant to the condenser in phase with the compression stage of the piston.

6. A method in accordance with claim 1 further comprising; creating a low pressure draw in the evaporator during the expansion stage wherein the liquid refrigerant evaporates providing cooling to the evaporator.

7. A method in accordance with claim 6 wherein liquid refrigerant in the evaporator is flash evaporated.

8. A method in accordance with claim 1 further comprising; creating an oscillation wherein the compression stage and the expansion stage of the piston device operate in an alternating fashion.

9. The method in accordance with claim 8 wherein the piston device is integrated with a U-tube concentrator comprising; a chamber with a piston; having the piston coupled by a liquid connecting rod to a heat engine.

10. The method in accordance with claim 9 further comprising creating an oscillation in the U-tube concentrator at or near resonant frequency.

11. The method in accordance with claim 10 further comprising; the heat engine receiving a quantity of energy from a solar collector.

12. The method in accordance with claim 11 further comprising; controllably matching the quantity of energy from the solar collector with a quantity of heat moving into the system from an enclosure.

13. A method in accordance with claim 11 further comprising; a reservoir or tank for storing low grade thermal energy the method further comprising using the previously stored low grade thermal energy from the reservoir or tank to power the U-tube concentrator.

14. A method for modulating operation of a condenser and an evaporator in a refrigeration system wherein refrigerant flow from the compressor and the evaporator elements are pulsed comprising:

a) providing a pulsed flow of refrigerant through a condenser, b) condensing the refrigerant to a liquid phase in the condenser, c) forming a pool of refrigerant in a collector at a relatively high pressure, d) drawing the refrigerant from the pool of the collector and, e) flowing the refrigerant through a pressure regulation valve, said valve being sized so as to provide a substantially constant flow across the pressure regulation valve, f) providing an evaporator comprising, a heat exchanger for receiving heat, a refrigerant reservoir substantially surrounding the heat exchanger, said refrigerant reservoir being sized to receive sufficient refrigerant to substantially submerge the heat exchanger during a pulsed evaporation process.

15. A refrigeration system comprising:

a) a chamber capable of containing refrigerant, b) said chamber being in connection with a movable piston, c) said piston being integrated with a U-tube concentrator comprising a heat engine and a liquid connecting rod, d) said piston being capable of back and forth strokes comprising a compression stage and expansion stage on the refrigerant, e) said chamber further being operatively coupled with a condenser and an evaporator such that;

f) the back and forth strokes of said piston work in concert with the condenser and the evaporator to create a refrigeration cycle.

16. A system in accordance with claim 15 wherein the U-tube concentrator receives heat energy in the form of an output from a solar collector.

17. A system in accordance with claim 16 wherein the output of the solar collector and the output of the refrigeration cycle are matched.

18. A system in accordance with claim 15 wherein the solar collector works in conjunction with a storage system whereby heated water is stored for later use.

19. A refrigeration system comprising:

a) a solar collector for gathering energy in the form of heat, b) U-tube concentrator for providing work to a piston device in the form of reciprocating strokes comprising a compression stroke and an expansion stroke, c) the piston device further comprising, a piston, a chamber for containing the piston, an outlet valve, an inlet valve, d) a means for supplying a refrigerant;

e) the outlet valve being connected with a condenser and being coordinated with the compression stroke of the piston device such that high pressure refrigerant is supplied to the condenser, f) said condenser having means for changing phase of the refrigerant from a vapor phase to a liquid phase, g) the condenser further being operatively connected with a pressure regulator for reducing pressure, h) the pressure regulator further being connected with an evaporator, i) said evaporator comprising a refrigerant reservoir being operatively coupled with a heat exchanger, j) said evaporator being operatively coupled with the inlet valve of the piston device and being coordinated with the expansion stroke of the piston device such that the pressure in the expansion chamber is reduced drawing said refrigerant liquid in said reservoir, whereby at least a portion of said refrigerant liquid is vaporized;

k) the heat exchanger further comprising a heat absorbing means and a heat radiating means, whereby said heat radiating means is in communication with said reservoir for removing enthalpy from said heat exchanger and said heat absorbing means is in communication with an enclosure, whereby said enclosure is cooled.

* * * * *